United States Patent [19]

Slapsys

[11] Patent Number: 4,646,506

[45] Date of Patent: Mar. 3, 1987

[54] LINEAR PANEL CEILINGS AND THE LIKE

[75] Inventor: Michael Slapsys, Toronto, Canada

[73] Assignee: Donn Incorporated, Westlake, Ohio

[21] Appl. No.: 813,923

[22] Filed: Dec. 27, 1985

[30] Foreign Application Priority Data

Jan. 8, 1985 [CA] Canada ..... 471677

[51] Int. Cl.[4] ..... E04B 1/60

[52] U.S. Cl. ..... 52/772; 52/483; 52/460

[58] Field of Search ..... 52/483, 484, 460, 489, 52/468, 738, 664, 668, 78, 473, 507, 772

[56] References Cited

U.S. PATENT DOCUMENTS

| | | | |
|---|---|---|---|
| 3,295,284 | 1/1967 | Tschiesche | 52/483 |
| 3,410,043 | 11/1968 | Rijnders | 52/460 X |
| 3,548,556 | 12/1970 | Vermeulen | 52/492 |
| 3,645,051 | 2/1972 | Kolesar | 52/28 |
| 3,678,641 | 7/1972 | Englund et al. | 52/484 |
| 4,245,446 | 1/1981 | Judkins | 52/232 |
| 4,270,327 | 6/1981 | Van Leeuwen | 52/488 |
| 4,272,937 | 6/1981 | Brugman | 52/483 |
| 4,308,706 | 1/1982 | Rijnders | 52/738 |
| 4,328,653 | 5/1982 | Anderle | 52/460 |
| 4,364,215 | 12/1982 | Gailey et al. | 52/488 |
| 4,483,116 | 11/1984 | Gailey | 52/484 |

FOREIGN PATENT DOCUMENTS

| | | | |
|---|---|---|---|
| 245210 | 2/1966 | Austria | 52/483 |
| 1918152 | 10/1970 | Fed. Rep. of Germany | 52/483 |
| 2458640 | 2/1981 | France | 52/484 |

*Primary Examiner*—William F. Pate, III
*Assistant Examiner*—Creighton Smith
*Attorney, Agent, or Firm*—Pearne, Gordon, McCoy & Granger

[57] ABSTRACT

A linear panel ceiling system is disclosed in which generally U-shaped elongated panels can be mounted in abutting relationship or in a spaced relationship. When the panels are installed in a spaced relationship, an insert is snapped into a groove extending lengthwise the adjacent panels to close the space between adjacent panels. The insert is supported throughout its length and does not tend to lift when pressure differential exists across the insert. The side legs of the panels are inclined inwardly a small amount so that when the panels are installed in an abutting relationship with the panel faces abutting, the legs diverge to allow installation and/or removal of panels from the mounting brackets.

10 Claims, 6 Drawing Figures

LINEAR PANEL CEILINGS AND THE LIKE

BACKGROUND OF THE INVENTION

This invention relates generally to ceiling structures, and more particularly to a novel and improved linear panel ceiling and the like.

PRIOR ART

Linear panel ceilings generally provide a plurality of spaced and parallel, elongated mounting brackets which are supported on the building structure, and which provide mounting means at intervals along their length. Elongated pans or panels are installed perpendicular to such brackets, and are connected thereto by the mounting means. Such pans or panels are generally U-shaped and provide the exposed wall or ceiling surface.

In some instances, such panels are shaped and supported so that adjacent panels abut and provide the entire exposed surface of the wall or ceiling. An example of such a system is illustrated in U.S. Pat. No. 3,548,556. In other instances, the adjacent panels are laterally spaced, as illustrated in U.S. Pat. Nos. 3,645,051; 3,678,641; 4,245,446; 4,270,327; 4,272,937; 4,308,706; and 4,364,215. None of such patents, however, disclose a structural combination in which panels can be installed in abutment or spaced.

In systems in which the panels are spaced, it has often been the practice to lay a contrasting color (usually black) insulating board over the panels to close the spaces therebetween and to provide acoustical absorption and insulation. Such an installation provides a system in which the visual effect is that of a plurality of separate and parallel beams suspended in space.

It is also known to install long, narrow inserts between spaced panel edges which bridge the space between the panels. An example of such inserts is illustrated in U.S. Pat. Nos. 3,645,051 and 3,678,641. Further, it is known to leave some or all of the spaces open so that conditioning air can flow through the spaces for ventilation, heating, or cooling.

SUMMARY OF THE INVENTION

There are a number of aspects to the present invention. In accordance with one aspect of the invention, a novel and improved linear panel ceiling or the like is provided in which the mounting brackets and the panels are structured so that adjacent panels can be installed in abutting relationship or can be spaced. Further, a given ceiling can be provided with both types of installations. When the panels are installed in abutting relationship, they provide a substantially planar, exposed surface without spaces between adjacent panels.

In the illustrated embodiment, panels are provided with a generally U-shaped cross section in which the side walls of the panels are inclined inwardly a small amount. Such inclination of the side walls spaces the side walls of adjacent panels at the mounting section of the system. Further, the support brackets are provided with mounting means at intervals along the length of the brackets, which intervals match the width of the exposed planar panel portion. Because the adjacent side walls of adjacent panels diverge as they extend from the exposed surface, difficulty is not encountered in snapping the panels into an abutting installed position. Further, with such structure, a simple sheet metal tool can be used to remove any given panels from an installed panel system.

As mentioned above, the same panels can be installed on the same mounting bracket in a spaced relationship. Such spaces between adjacent panels may be closed by a closure strip. The adjacent panels are formed with a groove adjacent to the inner edge of the side walls which extends the length of each panel and provides a mounting for the closure strips which supports such strips throughout their length when the strips are installed. Consequently, differential pressure existing across the system does not tend to displace the inserts. Still further, because the inserts snap into a fixed location in the system, the inserts are properly positioned in a uniform manner without difficulty at the time of installation.

These and other aspects of this invention are illustrated in the accompanying drawings, and are more fully described in the following specification.

DETAILED DESCRIPTION OF THE DRAWINGS

Figure 1:
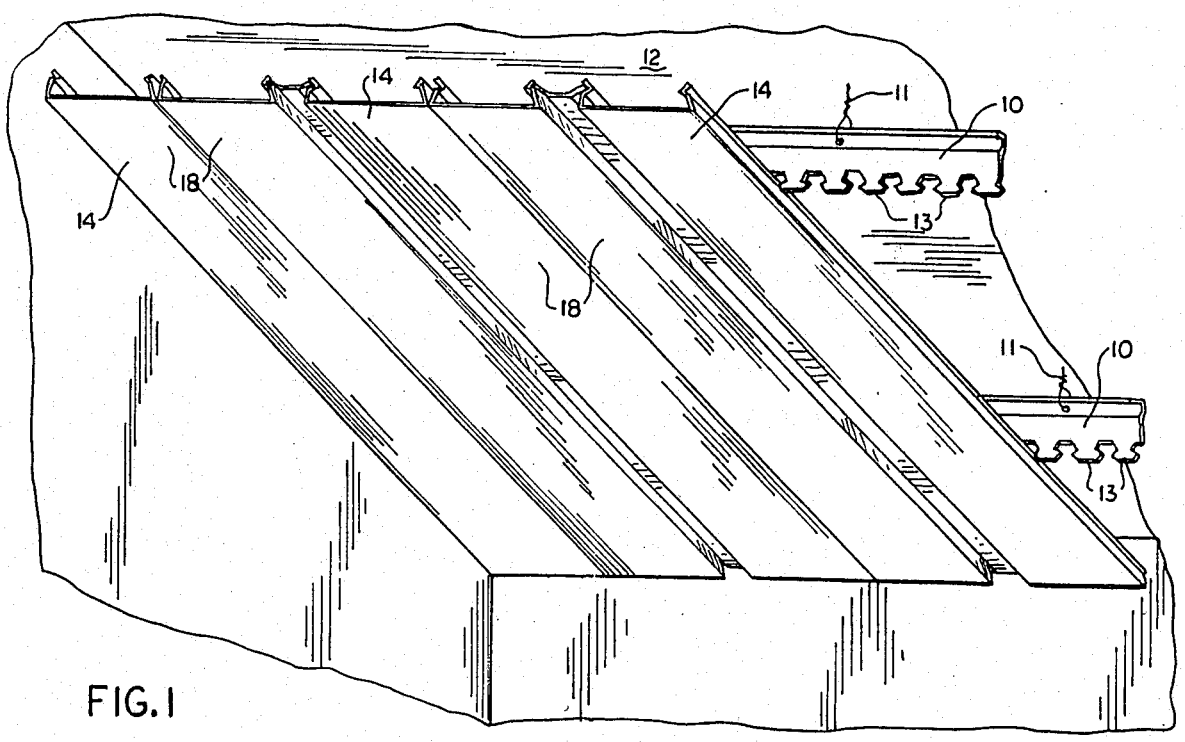
FIG. 1 is a perspective view of a portion of a linear panel ceiling in accordance with the present invention as viewed from below.

FIG. 1 illustrates a portion of a ceiling in accordance with the present invention installed within a room. It should be understood that a linear panel system in accordance with the present invention can be installed as a suspension ceiling in which the supporting brackets are suspended by wires or the like from the building structure or can be installed in a manner in which the brackets are secured directly to the building structure. It should also be understood that a panel system in accordance with this invention can also be installed along a wall surface, as well as along a ceiling surface, and as used herein the term "ceiling" is intended to encompass not only ceilings but vertical surfaces, such as walls or other room surfaces.

The illustrated system includes a plurality of spaced and substantially parallel, elongated brackets 10, which may, as mentioned, be suspended from the building structure by wires 11, or may be otherwise suitably supported directly on the adjacent building surface 12.

The brackets provide depending projections 13 at intervals along their length which provide a mounting means for elongated linear panels 14, which are generally U-shaped in cross section and are normally formed of sheet metal.

As best illustrated in FIGS. 2 through 5, the panels 14 provide a planar base wall 16 with upstanding spaced and substantially parallel legs 17 extending from the opposite edges of the base wall 16. Such legs are shaped along their upper edges to interfit with the projections 13 on the mounting brackets 10 so as to interconnect the panels and mounting brackets, as discussed in greater detail below.

Figure 2:
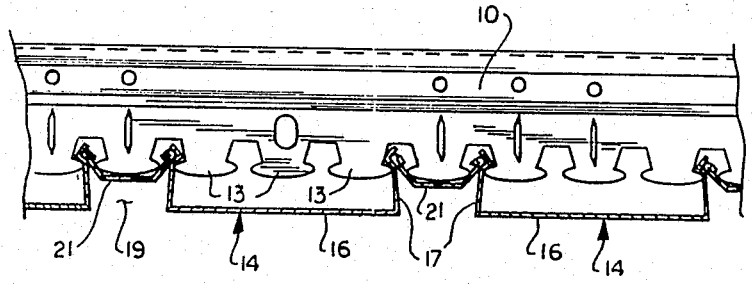
FIG. 2 is a vertical section through the end of the panel, illustrating the mounting thereof on the brackets when the panels are spaced from adjacent panels and inserts are installed to close the space between adjacent panels.
Figure 3:
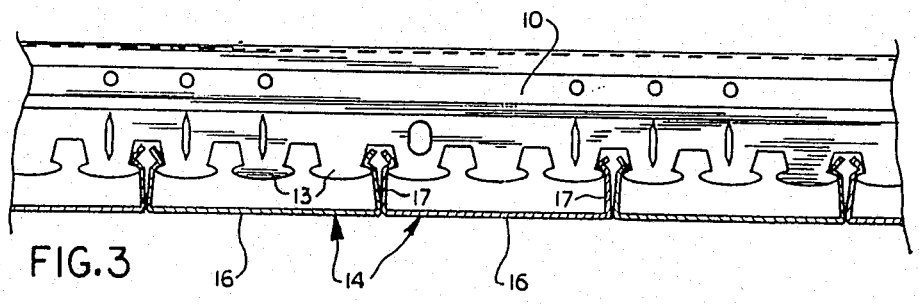
FIG. 3 is a view similar to FIG. 2, but illustrating panels installed in abutting relationship.
Figure 4:
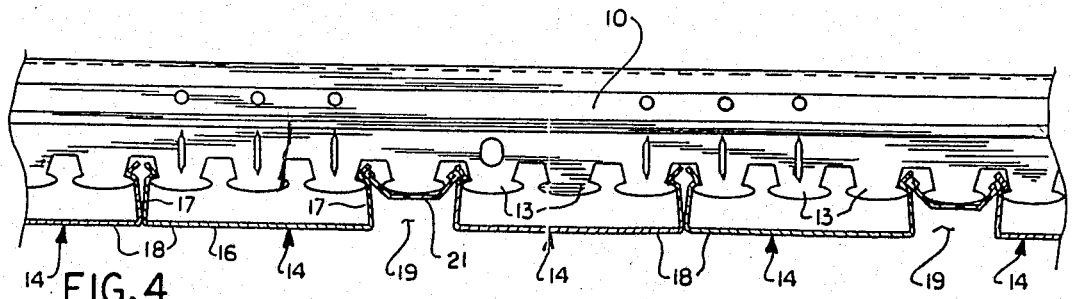
FIG. 4 is a vertical section illustrating a form of installation in which some adjacent panels are in abutting relationship while others are spaced from each other, and in which inserts are installed between the spaced panels.

The intervals of the projections 13 and the width of the panels 14 are selected so that the panels can be installed in abutting relationship or with spaces between some or all adjacent sides of adjacent panels. In FIG. 2, an installation pattern is illustrated in which each panel 14 is spaced from the next adjacent panel to provide spaces between each adjacent panel. In FIG. 3, an installation pattern is illustrated in which all of the adjacent panels are in abutting relationship so that the base walls 16 of the panels cooperate to provide a substantially uninterrupted, exposed wall or ceiling surface. FIGS. 1 and 4 illustrate an installation pattern in which pairs 18 of panels are installed in abutting relationship, with each pair spaced from the adjacent pair to provide a space 19 between the pairs of panels. It should be understood that other mounting patterns can be utilized, e.g., groups of three or four panels can be installed in abutting relationship with spaces between the groups. Further, the groups in a given system need not have the same number of panels in each group. Still further, panels of different width may be installed within a given system.

When some or all of the panels are installed in spaced relationship so as to provide spaces 19 between some or all of the adjacent panels, an insert 21 is installed in such spaces 19 to close such spaces.

Figure 5:
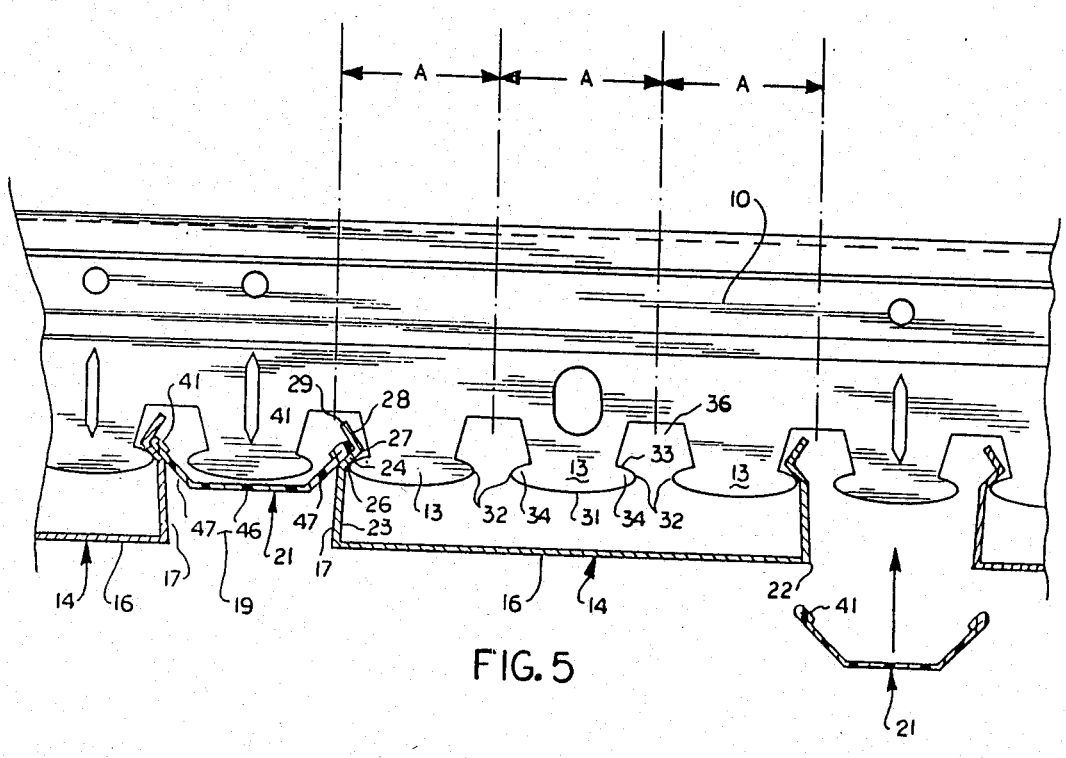
FIG. 5 is an enlarged, fragmentary section illustrating the structural detail of the insert and its mounting in the panel side wall.

FIG. 5 illustrates the structural detail of the inserts and their mounting in the spaces 19 between adjacent panels. In the illustrated embodiment, the legs 17 join the base wall 16 at relatively sharp corners 22 and converge at a small angle as they extend from the base wall. Such legs provide a relatively flat or planar portion 23 extending from the bends 22 to an inturned portion 24 joined to the planar portions 23 by a relatively sharp bend 26. The inturned portions extend a short distance to another relatively sharp bend at 27, from which a short outwardly extending wall portion 28 extends to an upper leg edge 29. The two portions 24 and 28 cooperate to provide a concave rib or groove 30 extending the length of the panel legs adjacent to the upper edges of such panel legs.

The projections 13 are formed by notching out the material of the bracket 10 so as to provide each projection with an upwardly curved lower edge 31 extending to extremities 32 and then extending inwardly along inward edge portions 33 so as to provide an end projection 34 along each side of each projection 13. The notches are also proportioned and shaped so that a relatively clear zone or space 26 is provided above the end projections 34.

When the panels 16 are installed on the brackets, the opposed or opposite legs 17 of the panel are raised up into engagement with the lateral end projections 34 of the mounting projections 13 and are pressed upwardly. This engagement produces a camming action, causing the legs to be deflected from their normal position until the panels snap into their installed position illustrated. In such position, the inturned portions 24 extend over the lateral end projections 34 to mechanically interlock the panels and the brackets so that the panels are supported by the brackets. Therefore, the brackets and panels provide interfitting, laterally extending projections which allow the easy mounting of the panels by merely moving them into their installed position.

The projections 13 are formed along the length of the brackets 10 at uniform intervals A and the panels have a base wall width which is equal to a multiple of the intervals A. For example, in the illustrated embodiment, the base portions 16 of the panels 14 have a width equal to three times the interval spacing A. However, other multiples may be utilized as desired.

Figure 6:
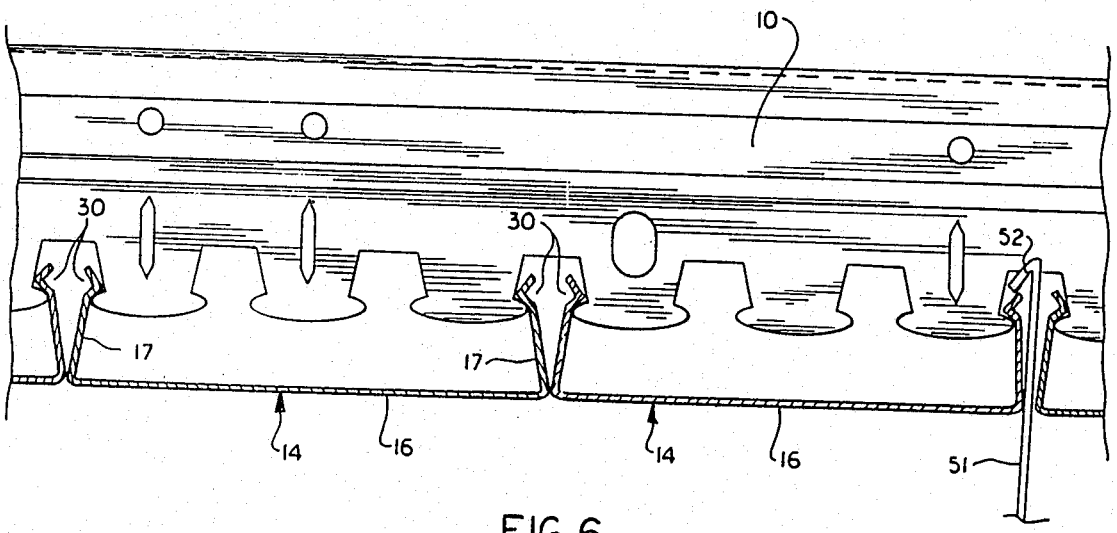
FIG. 6 is an enlarged, fragmentary section of the panel mounting in abutting relationship and also illustrating a tool which may be used to remove installed panels.

When the projections are formed at such intervals and the proper multiple relationship exists between the width of the base portion 16 and the intervals, the panels can be installed adjacent to each other in abutting contact, as illustrated in FIG. 6, or can be installed with spaces 19 between at least some of the adjacent panels, as illustrated in FIG. 5. Further, when such interval relationship is maintained, in which the width of the base portion 16 is a multiple of the interval A, panels of different widths can be installed in a given ceiling or wall system in various patterns.

The insert 21 is preferably formed of relatively light gauge sheet metal providing hemmed edges 41 which fit into the concave ribs or grooves 30 extending along the length of the associated legs 17. Consequently, the inserts 21 are supported and positioned throughout their length on the adjacent panels and are restrained against movement both in the upward and downward directions. Consequently, they do not tend to lift or drop when a pressure differential exists across the system created either by wind conditions or closing or opening of doors, for example.

The inserts are sized so that in their unstressed condition the edges 41 are spaced apart slightly more than in the installed positions so that the internal stresses in the insert maintain a positive force urging the hemmed edges 41 into the grooves of the adjacent panels. Consequently, there is virtually no tendency for the inserts to rattle or be displaced from their proper installed position. Further, the positive contact tends to provide a good seal which eliminates air leakage through the system.

In the illustrated embodiment, in which a projection 13 is located in each of the spaces 19, the inserts are formed with a shallow channel shape providing a bottom wall 46 and upwardly angulated side walls 47 so that the inserts can extend below the adjacent projection 13 without interference. However, because the inclined walls 47 extend upwardly, the full width of the legs 17 is visible. Normally, the inserts are provided with a contrasting color, usually black, with respect to the panels so that an appearance will be provided of a series of elongated panels suspended in space.

Referring to FIG. 6, the legs 17 are angulated inwardly at a small angle so that when adjacent panels 14 are installed in abutting relationship with the base wall of each panel extending to the adjacent base wall 16 of the adjacent panels 14, the rib edges of the legs remote from the base wall are spaced apart a small distance when they lock with the associated mounting projections. The spacing between adjacent end projections 34 is at least as great as the depth of the grooves 30 so that the grooved edges of the legs 17 of abutting installed panels are spaced apart by a distance at least equal to the depth of the groove 30. With such spacing, the legs of one installed panel do not interfere with the installation or removal of an adjacent abutting panel.

Still further, this structure, in which a space is provided between adjacent rib portions of adjacent legs, allows a panel to be removed from an installed system with the aid of a simple tool 51. Such tool is merely a piece of sheet metal strap provided with a bent-back hook portion 52 at one end. The tool can be inserted up between two adjacent panels and during such insertion, the bent-back hook portion is deflected in against the main body of the tool to allow easy insertion. Once the tool is fully inserted, the desired panel may be removed by merely pulling the tool down, causing the hook portion to engage and lock with the outwardly extending portion 28 so that the desired panel can be easily removed from an installed system.

Although the preferred embodiment of this invention has been shown and described, it should be understood that various modifications and rearrangements of the parts may be resorted to without departing from the scope of the invention as disclosed and claimed herein.

What is claimed is:

1. A linear panel system comprising elongated brackets providing mounting means at uniform intervals therealong, and elongated generally U-shaped panels having a width equal to a whole number multiple of said intervals, said panels providing a base and opposed legs extending from the edges of said base, said legs having inwardly extending ribs along the length thereof operable to snap over said mounting means to interconnect said panels and brackets, said legs and said mounting means being sized so that panels are installable on said elongated brackets with the bases thereof in abutting relationship with the base of an adjacent panel, said ribs being cammed apart during installation of said panels on said mounting means, said mounting means and ribs being sized so that adjacent ribs of adjacent panels are spaced apart a predetermined distance when said adjacent panels are installed in abutting relationship, with the base of one panel abutting the base of at least one adjacent panel.

2. A linear panel system as set forth in claim 1, wherein said legs are angulated inwardly to space said adjacent ribs when adjacent panels are installed in abutting relationship.

3. A linear panel system as set forth in claim 2, wherein said predetermined distance is at least substantially equal to the depth of said rib.

4. A linear panel system as set forth in claim 1, wherein said panels are selectively installable on said brackets in either spaced relationship or abutting relationship.

5. A linear panel system as set forth in claim 4, wherein said panels are formed of sheet metal and provide outwardly facing grooves within each rib, and inserts are provided with edges installable in opposed of said grooves to close the space between adjacent and spaced panels.

6. A linear panel system as set forth in claim 5, wherein said mounting means provides spaced oppositely extending projections over which said ribs snap, one of said mounting means of said elongated brackets being positioned between adjacent panels when adjacent panels are mounted on said brackets in spaced relationship and said inserts are shaped to fit around said projections and to expose substantially the entire width of said legs.

7. A linear panel system comprising a plurality of elongated, spaced and parallel mounting brackets supported on a building structure, said brackets providing panel mounting means at intervals along their length, and a plurality of elongated, generally U-shaped panels connected to said mounting means and supported by said brackets, at least some of said panels being spaced from an adjacent panel, others of said panels being mounted on said mounting means with the bases thereof in laterally abutting relationship, said U-shaped panels providing a base portion and spaced and substantially parallel legs extending from opposite edges thereof, said legs and mounting means providing interfitting projections extending substantially laterally with respect to said panels providing said connection therebetween.

8. A linear panel system as set forth in claim 7, wherein said legs provide laterally extending ribs extending along the length thereof, and inserts are positioned in and close the space between said adjacent panels, said inserts providing edge means interfitting with said ribs to support and position said inserts on said panels along substantially the entire length thereof and preventing movement of said inserts with respect to said adjacent panels caused by differences in pressure across said system.

9. A linear panel system as set forth in claim 8, wherein said outwardly extending portion also operates to cam said legs apart during installation of said panels on said mounting brackets.

10. A linear panel system as set forth in claim 9, wherein said base portion provides a width equal to a whole number multiple of said intervals.

* * * * *